US008291598B2

(12) United States Patent
Corron et al.

(10) Patent No.: US 8,291,598 B2
(45) Date of Patent: Oct. 23, 2012

(54) RETRACTABLE BLADE SCRAPER HAVING A BLADE-STORAGE DRAWER AND A BLADE SLIDE WITH UPPER AND LOWER BLADE-CLAMPING MEMBERS

(75) Inventors: Steven J. Corron, Shrewsbury, MA (US); Richard M. Farland, Slurbridge, MA (US); Corey Talbot, Hebron, CT (US)

(73) Assignee: Hyde Tools, Inc., Southbridge, MA (US)

( * ) Notice: Subject to any disclaimer, the term of this patent is extended or adjusted under 35 U.S.C. 154(b) by 364 days.

(21) Appl. No.: 12/803,102

(22) Filed: Jun. 18, 2010

(65) Prior Publication Data

US 2010/0325898 A1 Dec. 30, 2010

(51) Int. Cl.
*B26B 1/08* (2006.01)

(52) U.S. Cl. ..... 30/169; 30/125; 30/162

(58) Field of Classification Search ..... 30/125, 30/162, 169, 335

See application file for complete search history.

(56) References Cited

U.S. PATENT DOCUMENTS

| | | | | | |
|---|---|---|---|---|---|
| 2,236,323 | A * | 3/1941 | Stachowiak | 30/169 |
| 3,855,700 | A * | 12/1974 | Gerson et al. | 30/162 |
| 3,857,176 | A * | 12/1974 | Quenot | 30/162 |
| 3,964,162 | A | 6/1976 | Gerson et al. | |
| 3,983,595 | A * | 10/1976 | Knudsen et al. | 15/236.02 |
| 4,558,517 | A * | 12/1985 | Gringer | 30/169 |
| 4,922,610 | A * | 5/1990 | Szabo | 30/125 |
| 4,955,138 | A * | 9/1990 | Henke et al. | 30/169 |
| 5,319,853 | A * | 6/1994 | Schmidt | 30/169 |
| 5,433,004 | A * | 7/1995 | Thompson et al. | 30/169 |
| 6,286,215 | B1 * | 9/2001 | Panaccione | 30/169 |
| 6,510,612 | B1 * | 1/2003 | Cybulski | 30/162 |
| 6,775,912 | B2 * | 8/2004 | Panfili et al. | 30/169 |
| 7,150,102 | B2 * | 12/2006 | Gringer et al. | 30/172 |
| 7,647,702 | B2 * | 1/2010 | Polei | 30/162 |
| 8,171,646 | B2 * | 5/2012 | Chiu | 30/169 |
| 2004/0000055 | A1 * | 1/2004 | Lee Fan | 30/125 |
| 2005/0120564 | A1 * | 6/2005 | Chen Lin | 30/169 |

FOREIGN PATENT DOCUMENTS

WO WO 2010/147670 A1 * 12/2010

* cited by examiner

*Primary Examiner* — Hwei C Payer

(74) *Attorney, Agent, or Firm* — Louis J. Franco; Law Office of Louis J. Franco

(57) ABSTRACT

A retractable blade scraper includes a handle body having a handle rear end and a handle forward end including a forward-end opening. An internal blade-slide cavity extends rearwardly from the forward-end opening toward the handle rear end and is configured to selectively receive a blade through—the forward-end opening. A blade slide housed by the blade-slide cavity includes lower and upper blade slide members between which the blade is selectively retained. A blade-slide actuator is accessible through an actuator slot defined through a wall of the handle body between slot first and second ends. Reciprocation of the actuator between the slot first and second ends reciprocates the blade slide between a rearward blade-storage position in which the blade is housed in the blade-slide cavity and a forward blade-changing position in which the blade protrudes through the forward-end opening to facilitate blade changing. The actuator includes threadably cooperating members that facilitate the alternative clamping of a blade between and release of a blade from between the blade slide members when the blade slide is in the blade-changing position. A spare-blade storage drawer is housed within a blade-storage cavity and is accessible through a rear-end opening in the handle body.

12 Claims, 3 Drawing Sheets

RETRACTABLE BLADE SCRAPER HAVING A BLADE-STORAGE DRAWER AND A BLADE SLIDE WITH UPPER AND LOWER BLADE-CLAMPING MEMBERS

PROVISIONAL PRIORITY CLAIM

Priority based on Provisional Application Ser. No. 61/269,077 filed Jun. 20, 2009, and entitled "RETRACTABLE BLADE SCRAPER HAVING A BLADE-STORAGE DRAWER AND A BLADE SLIDE WITH UPPER AND LOWER BLADE-CLAMPING PORTIONS" is claimed. Moreover, the entirety of the previous provisional application, including the drawings, is incorporated herein by reference as if set forth fully in the present application.

BACKGROUND

Scrapers of various types and configurations have been produced by numerous manufacturers for over a century. A first category of scraper known to those of ordinary skill involved in the fabrication of such tools consists of retractable scrapers, which generally include a handle into which a blade slide carrying a blade can be selectively retracted. Two sub-categories of retractable scraper are exemplified by (i) a scraper in which a blade is carried by a blade slide and "sandwiched" between the blade slide and an interior surface of the handle and (ii) a scraper that includes a blade slide with upper and lower blade-engaging members between which the blade is retained at least in part by a biasing force produced by the flexing of at least one of the blade-engaging members. Scrapers of the first sub-category do not provide the same level of blade retention as those of the second sub-category. However, with scrapers of the second sub-category, blade removal is lateral relative to the longitudinal axis of the handle body, and can be difficult to remove. Examples of blade scrapers of the first and second sub-categories are illustrated in, respectively, U.S. Pat. No. to and U.S. Design Pat. No. D346319 to Lavallee et al.

In scrapers of the second category, the blade is retained between upper and lower clamping members that are alternatively drawn together and separated by a mechanism such as a threaded rod. However, in existing scrapers of this type, the blade is not retracted into a housing when not in use. Instead, the clamping mechanisms are loosened, the blade is flipped around such that the scraping and rear edges of the blade are reversed and the clamping mechanisms are again tightened to retain the blade for storage. It will be readily appreciated that scrapers of the second category have associated with them inconveniences not associated with scrapers of the first general category (i.e., retractable blade scrapers).

Accordingly, there exists a need for a blade scraper that facilitates, among other functions, selective retractability of the blade into a protective housing, longitudinal removability of the blade along the handle body axis, and the blade-retaining advantages of a scraper having a blade slide with upper and lower blade-engaging members.

SUMMARY

In each of various alternative embodiments, a retractable blade scraper configured for use with a scraping blade having a scraping edge includes a handle body extending longitudinally along a handle-body axis between a handle rear end and a handle forward end including a forward-end opening. The handle body further includes (i) a handle-body wall, (ii) a handle-body outer surface, (iii) a handle-body inner surface defining a blade-slide cavity extending rearwardly from the forward-end opening toward the handle rear end and configured to selectively receive a scraping blade through the forward-end opening, and (iv) an elongated actuator slot defined through the handle body and extending longitudinally between a slot first end and a slot second end. The slot is oriented such that the slot second end is more proximate the forward-end opening than is the slot first end.

Housed at least partially within the blade-slide cavity is a blade slide comprised of lower and upper blade slide members. The lower blade slide member has a blade platform configured for removably supporting a first flat surface of a scraping blade such that, when the blade slide is housed within the handle body, the scraping edge extends perpendicularly to the handle-body axis. The upper blade slide member includes a blade-engaging surface configured for selectively engaging a second surface of the blade opposite the first surface supported by the blade platform. More specifically, in an illustrative embodiment, the blade-engaging surface and the blade platform may be urged into cooperative clamping engagement with the scraping blade in a manner described more completely further in the summary and in the detailed description.

The blade slide is selectively displaced within the handle body through a blade-slide actuator. In each of various versions, the blade-slide actuator includes a first threaded member depending from the lower blade slide member and a second threaded is member that threadably engages that first threaded member and is accessible from the exterior of the handle body through the actuator slot. In one illustrative version, the first threaded member is a threaded stud that is restrained against rotation relative to the lower blade slide member and depends upwardly therefrom, and through an opening in the upper blade slide member, for threading engagement with the second threaded member. Irrespective of the particular configurations of the first and second threaded members, at least one of the first and second threaded members is accessible from the exterior of the handle body through the actuator slot. Rotation of the second threaded member in a first direction relative to the first threaded member urges the blade platform and upper blade slide member toward one another for clamping engagement of a scraping blade therebetween. Conversely, rotation of the second threaded member in a second direction opposite the first direction relative to the first threaded member one of (a) separates and (b) permits the separation of the upper blade slide member and the blade platform by an amount sufficient to facilitate the alternative positioning into and removal from the space between the upper blade slide member and the blade platform of a scraping blade.

In addition to facilitating the clamping of a blade between the upper and lower blade slide members, the blade-slide actuator facilitates reciprocation of the blade slide relative to the handle body. More specifically, reciprocal displacement of the blade-slide actuator toward, alternatively, the slot first and second ends displaces the blade slide toward, respectively, a rearwardmost blade-storage position in which the scraping edge of a scraping blade positioned on the blade platform does not extend beyond the forward-end opening and a forwardmost blade-changing position in which the blade platform extends out of the blade-slide cavity through the forward-end opening by an amount sufficient to permit the alternative removal of a scraping blade therefrom and placement of a scraping blade thereon.

In various versions, the blade slide is selectively lockable into at least one of (i) is the blade-storage position, (ii) the blade-changing position, and (iii) a blade-scraping position situated between the blade-storage and blade-changing positions. Facilitating the selective positional lockability is a lug that depends upwardly from the blade slide. An upper handle-body wall defines a lug-receiving opening corresponding to, and defining, each position in which the blade slide is lockable. Each lug-receiving opening is configured to lockably receive the lug depending from the blade slide when the blade slide is in the lockable position to which that lug-receiving opening corresponds. The lug is upwardly biased toward a locked position. In order to displace the lug from one of the locked positions so that the blade slide can be slidably displaced longitudinally relative to the handle body, the blade-slide actuator is downwardly depressible into a sliding position in which the lug is not lockably engaged with a lug-receiving opening.

Alternative embodiments of a retractable blade scraper within the scope and contemplation of the present invention accommodate on-board blade storage. In one such version, the handle-body includes a rear-end opening situated to the rear of the actuator slot. Defined within the handle body is a blade-storage cavity that extends from the rear-end opening and into the handle body. In a typical version, the rear-end opening is defined in the handle rear end of the handle body and the blade-storage cavity extends forwardly from the rear-end opening toward the handle forward end.

Received within the blade-storage cavity for reciprocation between open and closed positions is a blade drawer that is configured for the storage of at least one spare scraping blade of the type that the blade platform is configured to removably retain. In a version in which the rear-end opening is defined in the handle rear end, and the blade-storage cavity is accessed through, and extends forwardly of, the rear-end opening, the blade drawer is displaceable within the blade-storage cavity along the handle-body axis between a forwardmost closed position in which a blade positioned within the drawer is stored within the blade-storage cavity and a rearward open position in which the drawer extends out of the rear-end opening by an amount sufficient to render possible the alternative removal from and placement into the drawer of a scraping blade. While the rear-end opening of an illustrative version is defined in the handle rear end such that reciprocation of the blade drawer between the open and closed position occurs along the handle-body axis, absent explicit limitations to the contrary, within the scope and contemplation of the invention as defined in the appended claims are versions in which the rear-end opening is defined in the handle body such that reciprocation of the blade drawer occurs along an axis other than the handle-body axis.

Representative embodiments are more completely described and depicted in the following detailed description and the accompanying drawings.

DETAILED DESCRIPTION

The following description of variously embodied retractable blade scrapers is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims.

Figure 1:
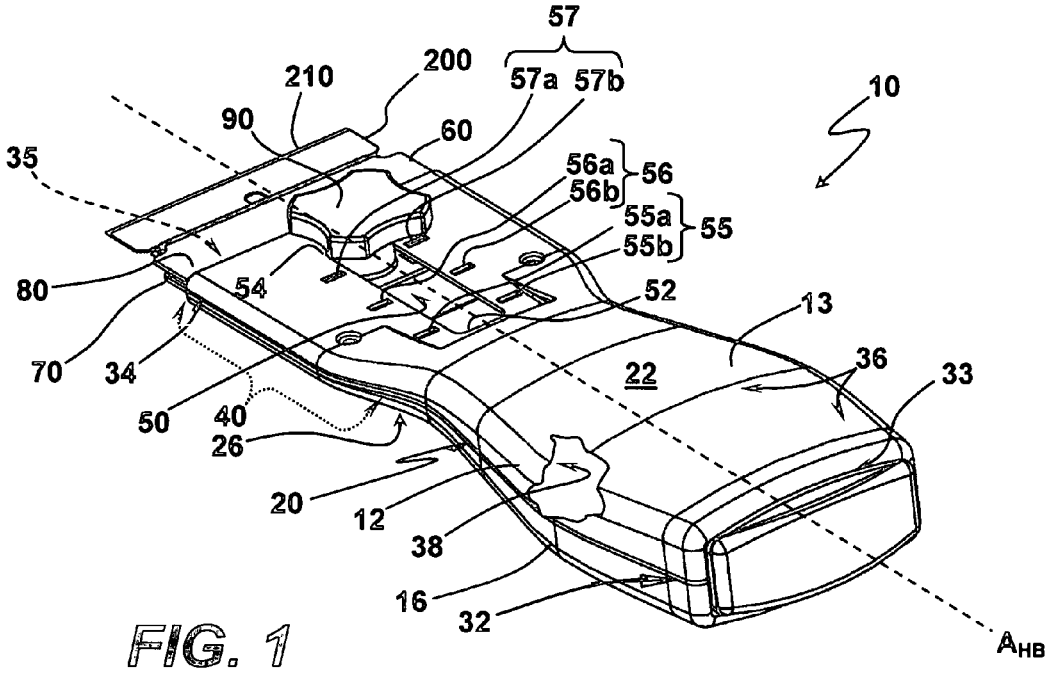
FIG. 1 is a left and rear side view of a retractable blade scraper with a blade drawer in a closed position.
Figure 2:
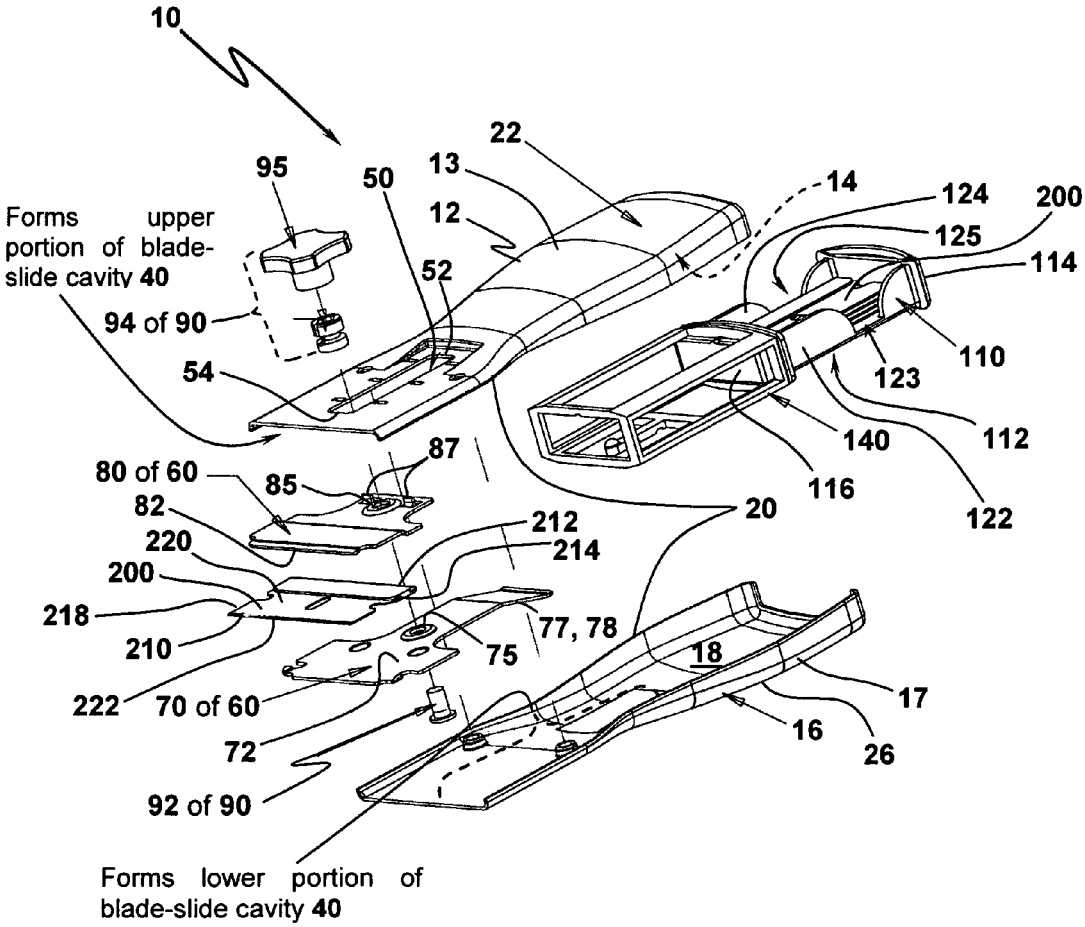
FIG. 2 is a left and front exploded view of the retractable blade scraper of FIGS. 1 and 1A.

Shown in FIG. 1, and the exploded view of FIG. 2, is an illustrative retractable blade scraper 10 configured for use with a removable scraping blade 200. The scraping blade 200 has a front scraping edge 210, a rear edge 212 opposite the scraping edge 210, opposed first and second side edges 214 and 218 extending between the scraping and rear edges 210 and 212, and opposed first and second flat surfaces 220 and 222 bounded by the edges 210, 212, 214, and 218. In the particular embodiment of FIGS. 1 and 2, the scraping blade 200 is rectangular. However, it is to be understood that, in the absence of explicit limiting language to the contrary, embodiments of a retractable blade scraper 10 configured for use with alternatively-shaped scraping blades 200 (e.g., curved blades or trapezoidal utility blades) are within the scope and contemplation of the invention as defined in the appended claims. Referring still to FIGS. 1 and 2, the blade scraper 10 has a handle body 20 and a blade slide 60 that is housed within the handle body 20 for linear reciprocation relative to thereto. As indicated in FIG. 2, the handle body 20 comprises upper and lower body portions 12 and 16 with, respectively, upper-portion outer and inner surfaces 13 and 14 and lower-portion outer and inner surfaces 17 and 18. As shown in FIG. 1, the upper and lower body portions 12 and 16 are joined to define a handle body 20 with upper and lower handle-body walls 22 and 26 that extend longitudinally along a handle-body axis $A_{HB}$ between a handle rear end 32 and a handle forward end 34 including a forward-end opening 35. Combined, the upper-portion and lower-portion outer surfaces 13 and 17 constitute at least a portion of a handle-body outer surface 36. Additionally, the combined upper-portion and lower-portion inner surfaces 14 and 18 combine to form a handle-body inner surface 38 that defines an internal blade-slide cavity 40 that extends rearwardly from the forward-end opening 35 toward the handle rear end 32 and is configured to selectively receive and house a scraping blade 200 through the forward end opening 35. Defined through the upper handle-body wall 22 is an elongated actuator slot 50. The actuator slot 50 extends longitudinally between a slot first end 52 and a slot second end 54 that is more proximate the forward-end opening 35 than is the slot first end 52. The purpose of the actuator slot 50 is subsequently explained in detail.

Figure 3:
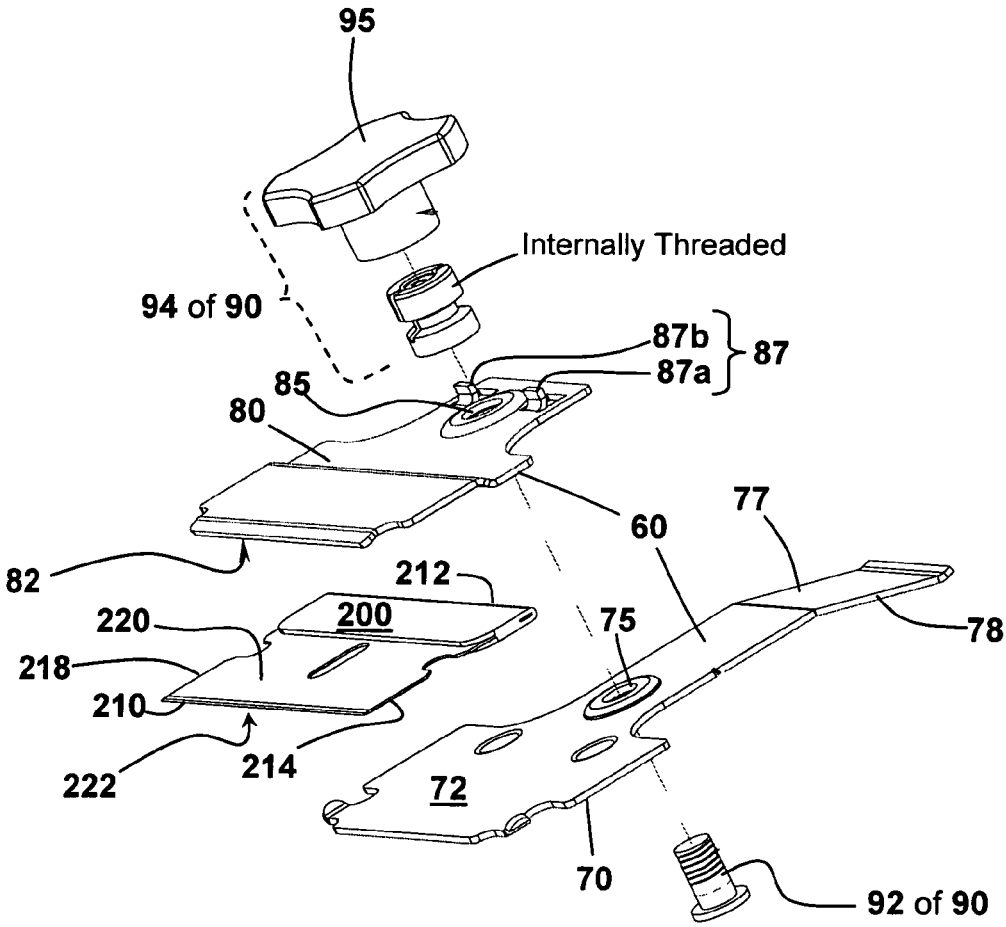
FIG. 3 is an exploded view of a blade slide assembly such as the blade slide assembly shown in FIG. 2.

With continued reference to FIG. 2, and additional reference to the exploded view of FIG. 3, the blade slide 60 includes lower and upper blade slide members 70 and 80. The lower blade slide member 70 includes a blade platform 72 configured for removably receiving and supporting one of the flat surfaces 220 and 222 of a scraping blade 200 such that, when the blade slide 60 is retained by the handle body 20, the scraping edge 210 of the scraping blade 200, when properly positioned upon the blade platform 72, extends perpendicularly to the handle-body axis $A_{HB}$ shown in FIG. 1. The upper blade slide member 80 includes a blade-engaging surface 82 configured for selectively engaging the flat surface 220 or 222 of the scraping blade 200 opposite the flat surface 220 or 222 supportably engaged by the blade platform 72. More specifically, the blade-engaging surface 82 and the blade platform 72 cooperate to selectively clamp a scraping blade 200 in a manner more completely described below.

As indicated most clearly in FIG. 2, the blade slide 60 is at least partially housed within the blade-slide cavity 40 for longitudinal reciprocation, relative to the handle body 20, between a rearwardmost blade-storage position in which the scraping edge 210 of a scraping blade 200 positioned on the blade platform 72 does not extend beyond the forward-end opening 35 and a forwardmost blade-changing position in which the blade platform 72 extends out of the blade-slide cavity 40, beyond the forward-end opening 35, by an amount sufficient to permit the alternative removal of a scraping blade 200 therefrom and placement of a scraping blade 200 thereon. Located between the blade-changing and blade-storage positions is a blade-scraping position. In at least one embodiment, the blade slide 60 is selectively lockable into at least its blade-storage and blade-scraping positions. The longitudinal reciprocation of the blade slide 60 between its blade-changing and blade-storage positions, and the locking thereof into at least the blade-storage and blade-scraping positions, is facilitated by a blade-slide actuator 90 that is accessible from the exterior of the handle-body 20 through the actuator slot 50. The functionality of the blade-slide actuator 90 is dual: to facilitate (i) the aforementioned longitudinal reciprocation of the blade slide 60 into different positions and (ii) the clamping of a scraping blade 200 between the blade platform 72 and the blade-engaging surface 82.

The dual functions of the blade-slide actuator 90 are explained with initial reference to FIGS. 2 and 3. Referring first to FIG. 3, the blade-slide actuator 90 of one illustrative embodiment includes a first threaded member 92 that extends upwardly from the lower blade slide member 70 and through an opening 85 in the upper blade slide member 80. The first threaded member 92 in one embodiment (not shown) is attached to, and extends upwardly from, a top surface of the lower blade slide member 70. In the particular version depicted, however, the first threaded member 92 is a threaded stud that extends upwardly through holes 75 and 85 in, respectively, the lower and upper blade slide members 70 and 80, and is restricted from rotating relative to the lower blade slide member 70. Irrespective of the manner of upward dependence of the to first threaded member 92 from the lower blade slide member 70, a second threaded member 94 includes threads (not shown) configured for threading engagement with the threads (not shown) of the first threaded member 92. With the blade slide 60 housed within the handle body 20, at least one of the first and second threaded members 92 and 94 is accessible from outside the handle body 20 through the actuator slot 50. In the particular version shown, at least a portion of the second threaded member 94 extends out of the handle body 20.

The first and second threaded members 92 and 94 cooperate such that rotation of one of the first and second threaded members 92 and 94 relative to the other of the threaded members 92 and 94 in a first direction urges the blade platform 72 and the blade-engaging surface 82 of the upper blade slide member 80 toward one another for selective clamping engagement of a scraping blade 200 therebetween. Conversely, rotation of one of the threaded members 92 and 94 in a second direction opposite the first direction relative to the other of the threaded members 92 and 94 one of (a) separates and (b) permits the separation of the blade-engaging surface 82 and the blade platform 72 by an amount sufficient to facilitate the alternative positioning into and removal from the space between the upper blade slide member 80 and the lower blade slide member 70 of a scraping blade 200 when the blade slide 60 is in a blade-changing position. In various versions, the separation of the blade-engaging surface 82 and the blade platform 72 is sufficient to facilitate alternative removal and insertion of a blade 200 longitudinally along the handle body axis $A_{HB}$, as opposed to the lateral blade removal and insertion required in association with existing retractable blade scrapers described in the background.

In the drawings cited in association with the description of the first and second threaded members 92 and 94, the designation of one of the threaded members as the first threaded member 92 and the other as the second threaded member 94 is entirely arbitrary. Moreover, even if the designations were not arbitrary, it will be appreciated that the description of the rotation of the second threaded member 94 with respect to the first threaded member 92, from the standpoint of spatial and mechanical relativism, is equivalent to stating that the first threaded member 92 is rotated relative to the second threaded member 94, irrespective of which of the threaded members 92 and 94 is actually held stationary relative to the lower blade slide member 70. With reference to FIGS. 1 through 3, the second threaded member 94 includes a knob 95 external to the handle body 20 in order to facilitate a user's rotation of the second threaded member 94 relative to the first threaded member 92.

With reference to FIG. 1, it will be further appreciated that the blade-slide actuator 90 also facilitates longitudinal reciprocation of the blade slide 60, relative of the handle body 20, between the previously described blade-storage and blade-changing positions. In other words, the blade-slide actuator 90 serves the same function as a "thumb button" or "finger button" associated with existing blade scrapers that are well-known to the user's of such scrapers and those of ordinary skill in the art of designing and fabricating the same. In the version depicted, the blade slide 60 is selectively lockable in each of the blade-storage and blade-changing positions, as well as a blade-scraping position between the blade-storage and blade-changing positions. The selective lockability of the blade slide 60 is facilitated as follows. Referring to FIGS. 2 and 3, extending upwardly from the blade slide 60, and, more particularly, in this case, the upper blade slide portion 80 is a lug set 87 including laterally spaced first and second lugs 87*a* and 87*b*. While two lugs 87*a* and 87*b* are shown in the illustrative version of FIG. 3, it will be appreciated that the lug set 87 may include an alternative quantity of lugs, including a single lug or three or more lugs. As shown in FIG. 1, included in the upper handle-body wall 22 are first, second and third lug-receiving opening sets 55, 56, and 57 that are mutually spaced along a portion of the longitudinal extent of the handle body 20. The first, second, and third lug-receiving opening sets 55, 56, and 57 correspond, respectively, to the blade-storage, blade-scraping, and blade-changing positions of the blade slide 60. Moreover, the first, second, and third lug-receiving opening sets 55, 56, and 57 include, respectively, openings 55*a* and 55*b*, 56*a* and 56*b*, and 57*a*, and 57*b*, laterally spaced and configured to selectively receive the lugs 87*a* and 87*b* when the blade slide 60 is alternatively in each of its respective blade-storage, blade-scraping, and blade-changing positions. It will be appreciated that, in any particular version, each of the lug-receiving opening sets 55, 56 and 57 includes a number of openings corresponding to the number of lugs included in the lug set 87.

The lug set 87 is mechanically biased toward the upper handle-body wall 22 so as to maintain the lug set 87 into mechanical engagement with one of the first, second and third lug-receiving opening sets 55, 56, and 57. That is, the lug set 87 is biased upwardly toward a locked position. In order to displace the lug set 87 from one of the locked positions so that the blade slide 60 can be displaced longitudinally relative to the handle body 20, the blade-slide actuator 90 is depressible toward the lower handle-body wall 26 into a sliding position in which the lug set 87 is disengaged from the lug-receiving opening sets 55, 56, and 57. With reference to FIG. 3, the lug set 87 is mechanically biased toward a locked position by a biasing member 77 that mechanically urges at least a portion of the blade slide 60 toward the upper handle-body wall 22. In the particular embodiment of the blade slide 60 depicted in FIGS. 2 and 3, the biasing member 77 is in the form of a resilient blade-slide tail 78 that depends rearwardly of the blade platform 72 and it bent downwardly for engagement with a portion of the lower handle-body wall 26.

Figure 1A:
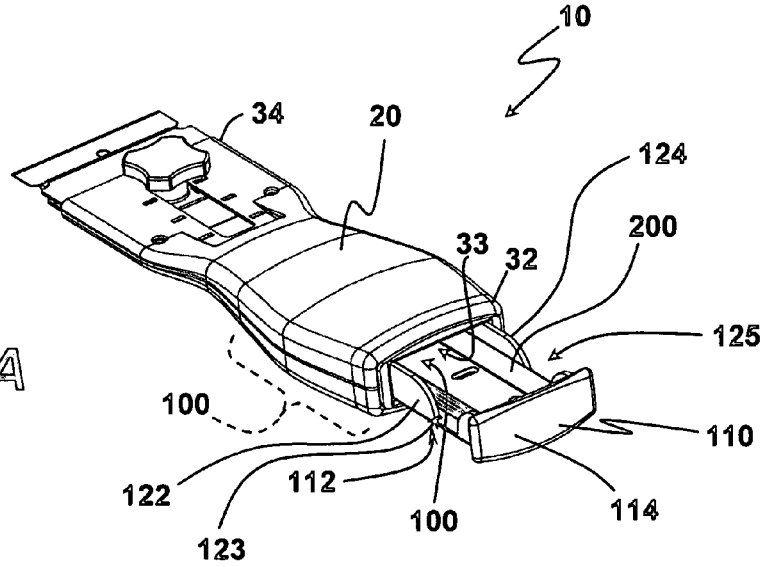
FIG. 1A is a view of the retractable blade scraper of FIG. 1 in which the blade drawer is in an open position.

Alternative versions of a retractable blade scraper 10 within the scope and contemplation of the invention include "on-board" blade storage. As shown in FIGS. 1 and 1A, the retractable blade scraper 10 illustratively includes a rear-end opening 33 in the handle rear end 32. The handle-body inner surface 38 defines a blade-storage cavity 100 that extends from the rear-end opening 33 toward the handle forward end 34. Slidably received within the blade-storage cavity 100 is a blade drawer 110 that is to configured for the storage of a least one scraping blade 200 of the type that the blade platform 72 is configured to removably retain. The blade drawer 110 includes a bottom wall 112, a rear wall 114, a front wall 116 (see FIG. 2), and first and second side walls 122 and 124, each of which extends at least partially between the rear and front walls 114 and 116. As shown in FIGS. 1A and 2, the first and second sides walls 122 and 124 include, respectively, wall interruptions 123 and 125. It will be appreciated that each of wall interruptions 123 and 125 facilitate access by a user's finger or a user-controlled implement (e.g. a pick) so that the user can remove one or more blades 200 from the blade drawer 110.

With particular reference to FIGS. 1 and 1A, the blade drawer 110 is displaceable along the handle-body axis $A_{HB}$ between a forwardmost closed position in which a blade 200 positioned within the drawer 110 is stored within the blade-storage cavity 100, as shown in FIG. 1, and a rearward open position in which the blade drawer 110 extends out of the blade-storage cavity 100 through the rear-end opening 33 such that a blade 200 can be alternatively removed from and placed into the drawer 110, as shown in FIG. 1A. In various alternative versions, the drawer 110 is removable from the blade-storage cavity 100 through the rear-end opening 33. Although the manner in which the drawer 110 is retained within the blade-storage cavity 100 of the handle body 20 is of no particular relevance to the inventive aspects of the present invention, in some versions, the drawer 110 is retained within the blade-storage cavity 100 by direct contact with portions of the handle-body inner surface 38. However, as shown in FIG. 2, the drawer 110 in the version of FIGS. 1 through 2 is retained by a drawer-retaining frame 140, which frame 140 is in turn retained within the blade-storage cavity 100. In the version shown in FIG. 2, the drawer-retaining frame 140 is an open framework, but it will be readily appreciated that the drawer-retaining frame 140 could be of an alternative configuration such as "pocket" or "sleeve" by way of non-limiting example.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A retractable blade scraper for use with a removable scraping blade having a scraping edge and two opposed flat surfaces, the blade scraper comprising:

a handle body having a handle rear end, a handle forward end including a forward-end opening, an internal blade-slide cavity extending rearwardly from the forward-end opening toward the handle rear end and configured to selectively receive the scraping blade through the forward-end opening, and an actuator slot defined through the handle body between a slot first end and a slot second end, the second end being more proximate the forward-end opening than is the first end;

a blade slide housed at least partially within the blade-slide cavity and comprising:

(i) a lower blade slide member with a blade platform configured for removably supporting one of the flat surfaces of the scraping blade, and (ii) an upper blade slide member configured for selectively engaging the flat surface of the scraping blade opposite the flat surface supported by the blade platform; and a blade-slide actuator including a first threaded member depending from the lower blade slide member and a second threaded member that threadably engages the first threaded member and is accessible from the exterior of the handle body through the actuator slot;

wherein (i) rotation of the second threaded member in a first direction relative to the first threaded member urges the blade platform and the upper blade slide member toward each another for clamping engagement of the scraping blade therebetween; (ii) rotation of the second threaded member in a second direction opposite the first direction relative to the first threaded member one of (a) separates and (b) permits the separation of the upper blade slide member and the blade platform by an amount sufficient to facilitate the alternative positioning into and removal from the space between the upper blade slide member and the blade platform of the scraping blade; and (iii) reciprocal displacement of the blade-slide actuator toward, alternatively, the slot first and second ends displaces the blade slide toward, respectively, a rearwardmost blade-storage position and a forwardmost blade-changing position.

2. The scraper of claim 1 wherein at least one of:

(i) the blade-storage position is such that the scraping edge of the scraping blade positioned on the blade platform does not extend beyond the forward-end opening; and (ii) the blade-changing position is such that the blade platform extends out of the blade-slide cavity through the forward-end opening by an amount sufficient to permit the alternative removal of a scraping blade therefrom and placement of another scraping blade thereon.

3. The scraper of claim 2 wherein the blade slide is selectively lockable in at least one of (i) the blade-storage, (ii) the blade-changing, and (iii) a blade-scraping position situated between the blade-storage and blade-changing positions.

4. The scraper of claim 3 wherein (i) the handle body has an upper handle-body wall through which the actuator slot is defined;

(ii) the blade slide includes a lug depending upwardly toward the upper handle-body wall;

(iii) the upper handle-body wall defines a lug-receiving opening corresponding to, and defining, each position in which the blade slide is lockable, said lug-receiving opening being configured to lockably receive the lug depending from the blade slide when the blade slide is in the lockable position to which that lug-receiving opening corresponds;

(iv) the lug is upwardly biased toward a locked position; and (v) the lug can be displaced from a locked position so that the blade slide can be slidably displaced relative to the handle body by downwardly depressing the blade-slide actuator into a sliding position in which the lug is not lockably engaged with said lug-receiving opening.

5. The scraper of claim 1 wherein (i) the handle rear end includes a rear-end opening;

(ii) the handle body defines a blade-storage cavity extending forwardly from the rear-end opening toward the handle forward end; and (iii) the scraper further includes a blade drawer that (a) is configured for the storage of at least one blade of the type that the blade platform is configured to removably retain and (b) is displaceable within the blade-storage cavity between a closed position in which a blade positioned within the drawer is stored within the blade-storage cavity and an open position in which a blade can be alternatively removed from and placed into the drawer.

6. The scraper of claim 5 wherein the drawer is removable from the blade-storage cavity.

7. The scraper of claim 6 wherein the blade-platform is configured to retain a rectangular scraping blade.

8. A retractable blade scraper for use with a removable scraping blade having a scraping edge and two opposed flat surfaces, the blade scraper comprising:

a handle body having upper and lower handle-body walls and extending longitudinally along a handle-body axis between a handle rear end and a handle forward end including a forward-end opening, the handle body further having (i) a handle-body outer surface, (ii) a handle-body inner surface defining a blade-slide cavity extending rearwardly from the forward-end opening toward the handle rear end and configured to selectively receive a scraping blade through the forward-end opening, and (iii) an elongated actuator slot defined through the upper handle-body wall and extending longitudinally between a slot first end and a slot second end, wherein the second end is more proximate the forward-end opening than is the first end;

a blade slide housed at least partially within the blade-slide cavity and comprising:

(i) a lower blade slide member with a blade platform configured for removably supporting one of the flat surfaces of the scraping blade such that the scraping edge extends perpendicularly to the handle-body axis, and (ii) an upper blade slide member configured for selectively engaging the flat surface of the scraping blade opposite the flat surface supported by the blade platform; and a blade-slide actuator including a first threaded member depending from the lower blade slide member and a second threaded member that threadably engages the first threaded member and is accessible from the exterior of the handle body through the actuator slot;

wherein (i) rotation of the second threaded member in a first direction relative to the first threaded member urges the blade platform and the upper blade slide member toward each another for clamping engagement of the scraping blade therebetween; (ii) rotation of the second threaded member in a second direction opposite the first direction relative to the first threaded member one of (a) separates and (b) permits the separation of the upper blade slide member and the blade platform by the amount sufficient to facilitate the alternative positioning into and removal from the space between the upper blade slide member and the blade platform of a scraping blade; and (iii) reciprocal displacement of the blade-slide actuator toward, alternatively, the slot first and second ends displaces the blade slide toward, respectively, a rearwardmost blade-storage position in which the scraping edge of the scraping blade positioned on the blade platform does not extend beyond the forward-end opening and a forwardmost blade-changing position in which the blade platform extends out of the blade-slide cavity beyond the forward-end opening by an amount sufficient to permit the alternative removal of the scraping blade therefrom and placement of another scraping blade thereon.

9. The scraper of claim 8 wherein (i) the blade slide is selectively lockable in at least one of (a) the blade-storage, (b) the blade-changing, and (c) a blade-scraping position situated between the blade-storage and blade-changing positions;

(ii) the blade slide includes a lug extending upwardly toward the upper handle-body wall;

(iii) the upper handle-body wall defines a lug-receiving opening corresponding to, and defining, each position in which the blade slide is lockable, said lug-receiving opening being configured to lockably receive the lug when the blade slide is in the lockable position to which that lug-receiving opening corresponds; and (iv) the lug is upwardly biased toward a locked position and can be displaced from a locked position so that the blade slide can be displaced longitudinally relative to the handle body by depressing the blade-slide actuator toward the lower handle-body wall and into a sliding position in which the lug is not lockably engaged with said lug-receiving opening.

10. The scraper of claim 9 wherein (i) the handle rear end includes a rear-end opening;

(ii) the handle-body inner surface further defines a blade-storage cavity extending forwardly from the rear-end opening toward the handle forward end; and (iii) the scraper further includes a blade drawer that (a) is configured for the storage of at least one blade of the type that the blade platform is configured to removably retain and (b) the blade drawer is displaceable within the blade-storage cavity along the handle-body axis between a forwardmost closed position in which a blade positioned within the drawer is stored within the blade-storage cavity and a rearward open position in which the drawer extends out of the rear-end opening such that a blade can be alternatively removed from and placed into the drawer.

11. The scraper of claim 8 wherein (i) the handle rear end includes a rear-end opening;

(ii) the handle-body inner surface further defines a blade-storage cavity extending forwardly from the rear-end opening toward the handle forward end; and (iii) the scraper further includes a blade drawer that (a) is configured for the storage of at least one blade of the type that the blade platform is configured to removably retain and (b) is displaceable within the blade-storage cavity along the handle-body axis between a forwardmost closed position in which a blade positioned within the drawer is stored within the blade-storage cavity and a rearward open position in which the drawer extends out of the rear-end opening such that a blade can be alternatively removed from and placed into the drawer.

12. A retractable blade scraper for use with a removable scraping blade having a to scraping edge and two opposed flat surfaces, the blade scraper comprising:

a handle body having upper and lower handle-body walls and extending longitudinally along a handle-body axis between a handle rear end including a rear-end opening and a handle forward end including a forward-end opening, the handle body further having (i) a handle-body outer surface, (ii) a handle-body inner surface defining (a) a blade-slide cavity extending rearwardly from the forward-end opening toward the handle rear end, and configured to selectively receive a scraping blade through the forward-end opening, and (b) a blade-storage cavity extending forwardly from the rear-end opening toward the handle forward end, and (iii) an elongated actuator slot defined through the upper handle-body wall and extending longitudinally between a slot first end and a slot second end, wherein the second end is more proximate the forward-end opening than is the first end;

a blade slide housed at least partially within the blade-slide cavity and comprising:

(i) a lower blade slide member with a blade platform configured for removably supporting one of the flat surfaces of the scraping blade such that the scraping edge extends perpendicularly to the handle-body axis, and (ii) an upper blade slide member configured for selectively engaging the flat surface of the scraping blade opposite the flat surface supported by the blade platform;

a blade-slide actuator including a first threaded member depending from the lower blade slide member and a second threaded member that threadably engages the first threaded member and is accessible from the exterior of the handle body through the actuator slot; and a blade drawer that (a) is configured for the storage of at least one blade of the type that the blade platform is configured to removably retain and (b) is to displaceable within the blade-storage cavity along the handle-body axis between a forwardmost closed position in which a blade positioned within the drawer is stored within the blade-storage cavity and a rearward open position in which the drawer extends out of the rear-end opening such that the blade can be alternatively removed from and placed into the drawer;

wherein (i) rotation of the second threaded member in a first direction relative to the first threaded member urges the blade platform and the upper blade slide member toward each other for clamping engagement of the scraping blade therebetween; (ii) rotation of the second threaded member in a second direction opposite the first direction relative to the first threaded member one of (a) separates and (b) permits the separation of the upper blade slide member and the blade platform by an amount sufficient to facilitate the alternative positioning into and removal from the space between the upper blade slide member and the blade platform of the scraping blade; and (iii) reciprocal displacement of the blade-slide actuator toward, alternatively, the slot first and second ends displaces the blade slide toward, respectively, a rearwardmost blade-storage position in which the scraping edge of the scraping blade positioned on the blade platform does not extend beyond the forward-end opening and a forwardmost blade-changing position in which the blade platform extends out of the blade-slide cavity beyond the forward-end opening by an amount sufficient to permit the alternative removal of the scraping blade therefrom and placement of another scraping blade thereon.

* * * * *